US009059546B2

(12) United States Patent
Yu et al.

(10) Patent No.: US 9,059,546 B2
(45) **Date of Patent: *Jun. 16, 2015**

(54) ELECTRICAL CONNECTOR

(71) Applicant: ALLTOP ELECTRONICS (SUZHOU) LTD., Taicang, JiangSu Province (CN)

(72) Inventors: Wang-I Yu, Jhonghe (TW); Hung-Chi Tai, Jhonghe (TW); Yung-Chih Hung, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/013,245

(22) Filed: Aug. 29, 2013

(65) Prior Publication Data

US 2014/0004747 A1 Jan. 2, 2014

Related U.S. Application Data

(63) Continuation-in-part of application No. 13/343,090, filed on Jan. 4, 2012, now Pat. No. 8,545,270.

(30) Foreign Application Priority Data

Oct. 25, 2011 (CN) ..... 2011 1 0326610

(51) Int. Cl.

| | |
|---|---|
| ***H01R 13/60*** | (2006.01) |
| ***H01R 24/20*** | (2011.01) |
| ***H01R 9/03*** | (2006.01) |
| ***H01R 9/24*** | (2006.01) |
| ***H01R 31/08*** | (2006.01) |
| *H01R 27/02* | (2006.01) |

(52) U.S. Cl.
CPC ..... *H01R 24/20* (2013.01); *H01R 9/03* (2013.01); *H01R 9/24* (2013.01); *H01R 27/02* (2013.01); *H01R 31/085* (2013.01)

(58) Field of Classification Search
CPC ..... H01R 24/20; H01R 9/03; H01R 27/02
USPC ..... 439/79, 540.1, 626, 638, 660
See application file for complete search history.

(56) References Cited

U.S. PATENT DOCUMENTS

| | | | | |
|---|---|---|---|---|
| 8,002,584 | B1 | 8/2011 | Hsu et al. | |
| 8,021,191 | B2 | 9/2011 | Long | |
| 8,137,138 | B2 | 3/2012 | Dowhower et al. | |
| 8,308,513 | B2 | 11/2012 | Hsu et al. | |
| 8,419,476 | B1 * | 4/2013 | Yu et al. | 439/626 |
| 2012/0184145 | A1 | 7/2012 | Zeng | |

* cited by examiner

*Primary Examiner* — Khiem Nguyen
(74) *Attorney, Agent, or Firm* — Sughrue Mion, PLLC

(57) ABSTRACT

An electrical connector includes an insulating housing, a number of power contacts received in the insulating housing, a power bus bar electrically and mechanically connecting with at least one power contact and a power contact spacer assembled within said opening of the insulating housing. Each power contact forms a first engaging portion and a first contacting portion. The power bus bar has a main section, a middle section extending from the main section, and a connecting section extending from the middle section. The power contact spacer includes a main body and a base extending downwards from the main body. The main body provides a number of protrusions along the transversal direction, and the insulating housing defines a number of grooves on a top wall thereof for correspondingly receiving the protrusions to thereby secure the power contact spacer on the insulating housing along a transversal direction.

14 Claims, 20 Drawing Sheets

ELECTRICAL CONNECTOR

CROSS-REFERENCE TO RELATED APPLICATION

This application is a Continuation-In-Part (CIP) application of U.S. patent application Ser. No. 13/343,090, filed Jan. 4, 2012, and entitled "ELECTRICAL CONNECTOR", which has the same assignee as the present invention.

BACKGROUND OF THE INVENTION

1. Field of the Invention

The present invention relates to an electrical connector, and more particularly to an electrical connector connecting with a cable.

2. Description of Related Art

China Patent No. 10187995, issued on Nov. 25, 2009, discloses a conventional electrical connector for transmitting power. The connector includes an insulating housing with a number of power contacts received therein. The insulating housing provides a mating face for mating with a complementary connector, a mounting face for mounting to a printed circuit board. A plurality of walls formed between the mating face and the mounting face with a receiving space being defined therebetween. The pitch of tails of the power contacts is small. When the connector is designed to connecting with a cable, it will be difficult to connect the cable and the tails of the power contacts.

Hence, an electrical connector with improved structure to overcome above-described shortcoming is needed.

BRIEF SUMMARY OF THE INVENTION

The present invention provides an electrical connector for connecting with a cable. The electrical connector includes an insulating housing, a number of power contacts received in the insulating housing, a power bus bar electrically and mechanically connecting with at least one power contact and a power contact spacer assembled within said opening of the insulating housing. Each power contact forms a first engaging portion and a first contacting portion. The power bus bar has a main section, a middle section extending from the main section, and a connecting section extending from the middle section. The power contact spacer includes a main body and a base extending downwards from the main body. The main body provides a number of protrusions along the transversal direction, and the insulating housing defines a number of grooves on a top wall thereof for correspondingly receiving the protrusions to thereby secure the power contact spacer on the insulating housing along a transversal direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
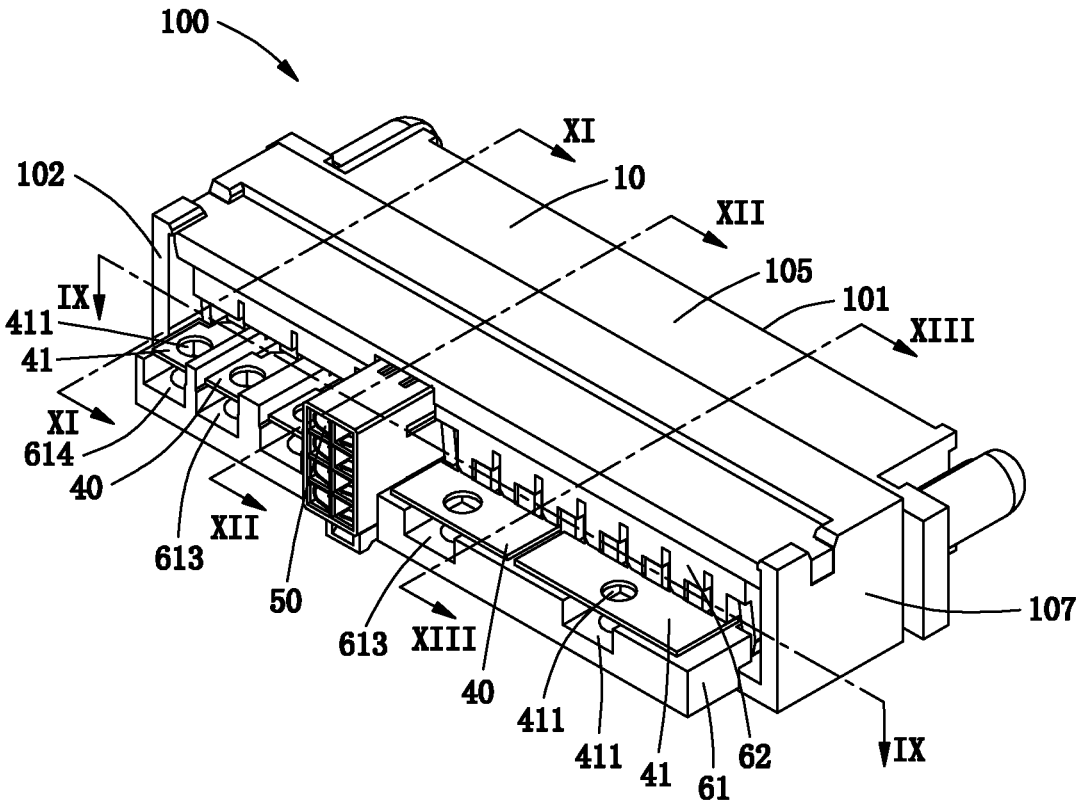
FIG. 1 is a perspective view of an electrical connector in accordance with the present invention.

Reference will now be made to the drawing figures to describe the embodiments of the present invention in detail. In the following description, the same drawing reference numerals are used for the same elements in different drawings.

Figure 2:
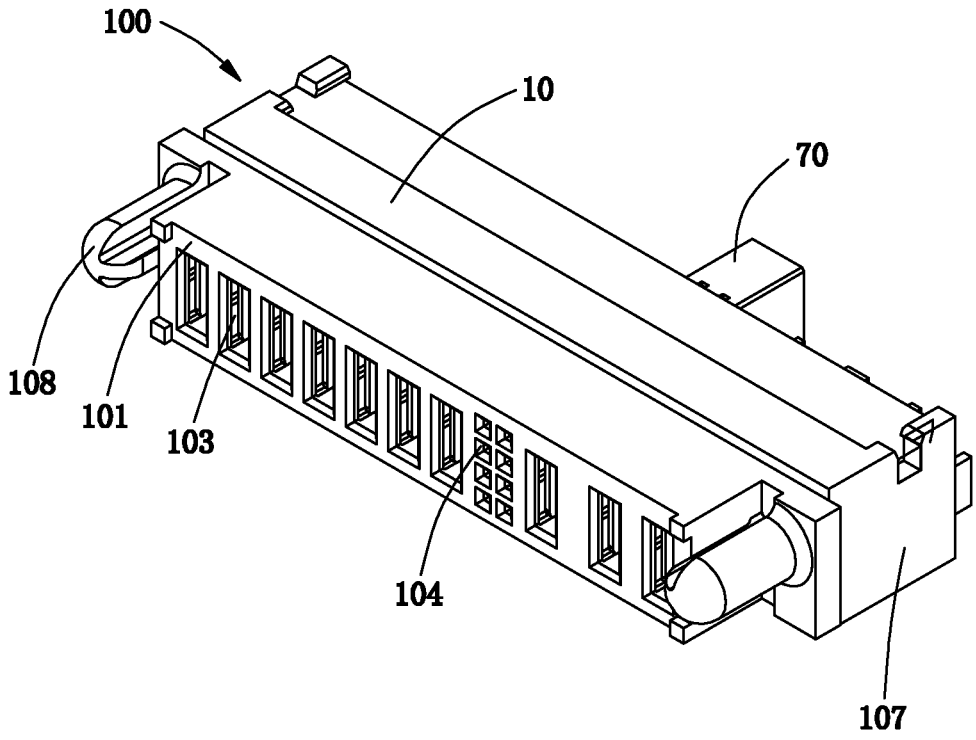
FIG. 2 is another perspective view of the electrical connector assembly shown in FIG. 1.
Figure 4:
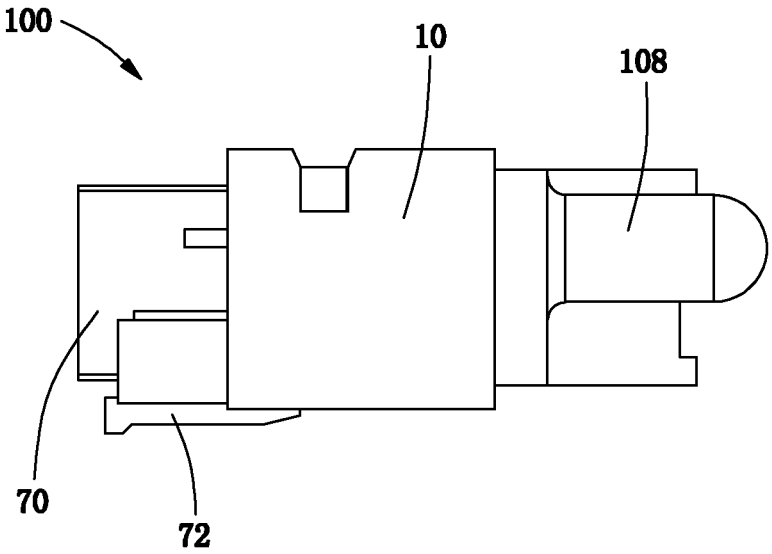
FIG. 4 is an exploded, perspective view of the electrical connector.
Figure 5:
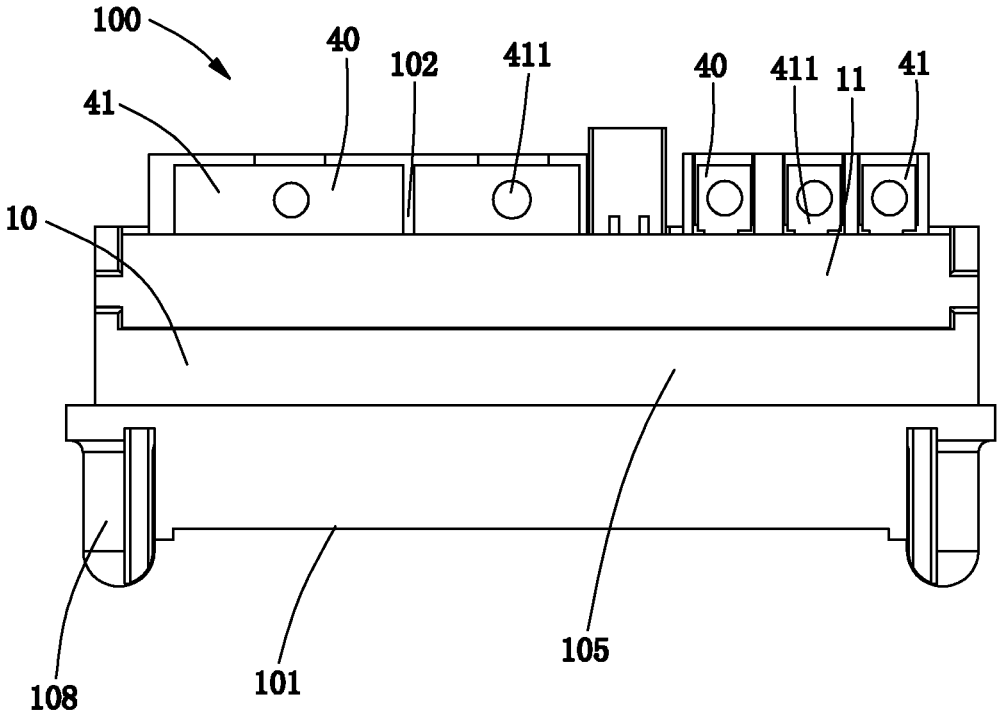
FIG. 5 is a view similar to FIG. 4 while taken from a different aspect.
Figure 6:
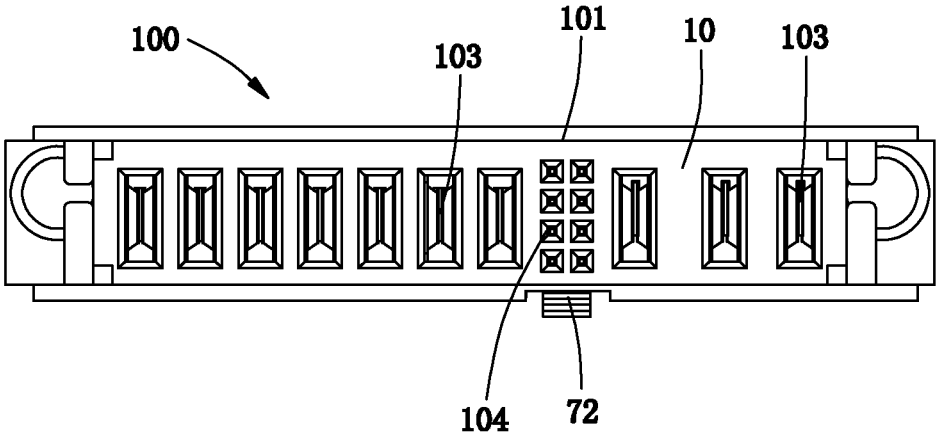
FIG. 6 is a side view of the electrical connector.
Figure 7:
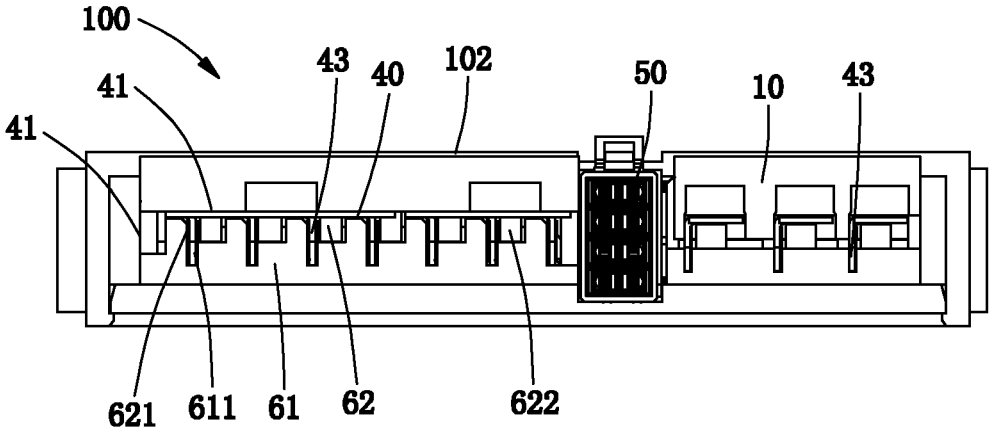
FIG. 7 is a top plan view of the electrical connector.
Figure 8:
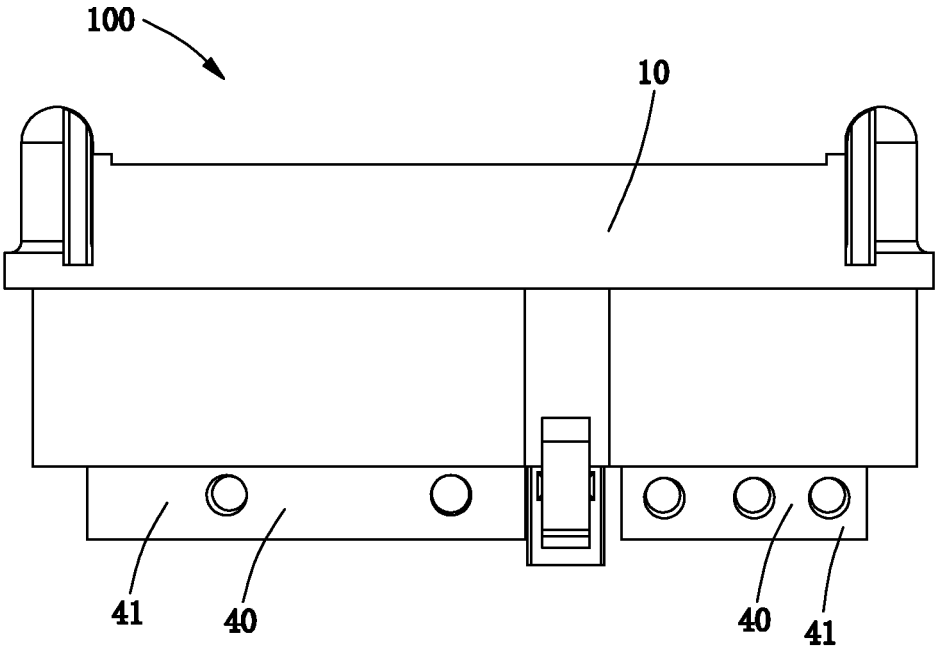
FIG. 8 is a front view of the electrical connector.
Figure 9:
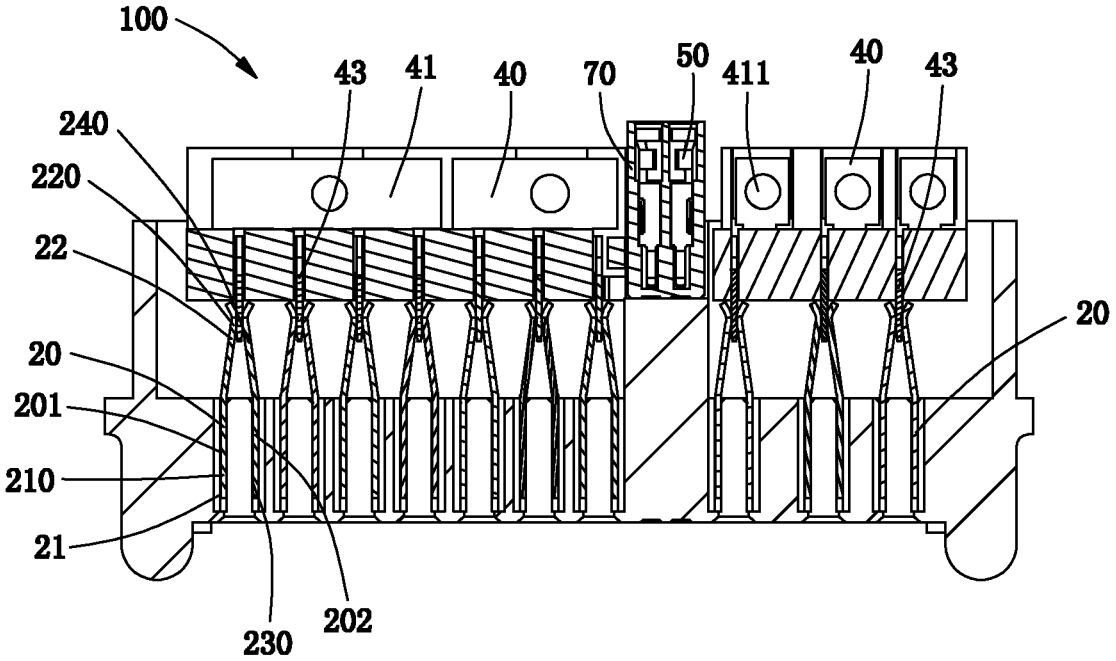
FIG. 9 is a rear view of the electrical connector.
Figure 10:
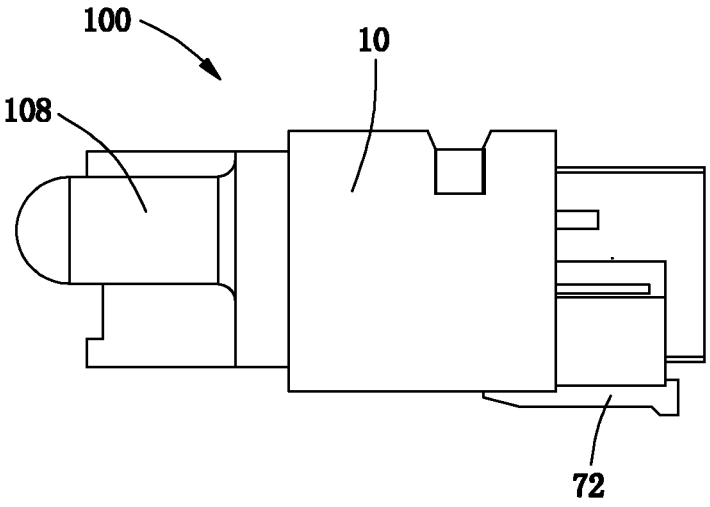
FIG. 10 is a bottom plan view of the electrical connector.

Referring to FIGS. 1-2 together with FIGS. 4-5, an electrical connector 100 in accordance with the present invention, which is configured to connect with a cable (not shown), comprises an insulating housing 10, a plurality of power contacts 20 assembled in the insulating housing 10, a plurality of signal contacts 30 received in the insulating housing 10, a plurality of power bus bars 40 connecting with the power contacts 20, a plurality of signal bus bars 50 connecting with the signal contacts 30, a first spacer 60 assembled to the insulating housing 10 for securing the power bus bars 40, and a second spacer 70 assembled to the insulating housing 10 for securing the signal bus bars 50. In the preferred embodiment, the electrical connector 100 comprises ten power contacts 20, eight signal contacts 30, five power bus bars 40, and eight signal bus bars 50. The power contacts 20 and the power bus bars 40 are arranged at opposite sides of the signal contacts 30 along a transversal direction of the electrical connector 100. One of the power bus bars 40 connects simultaneously with three power contacts 20. One of the power bus bars 40 connects simultaneously with four power contacts 20. Each of the rest of the power bars 40 connects respectively with one power contact 20. The signal contacts 30 and the signal bus bar 50 are arranged in two columns along a height direction of the connector 100. Each single contact 30 connects with one signal bus bar 50. As can be understood, the number and the connecting methods of the contacts and the bus bars in other embodiments can be different according to application requirements.

Figure 3:
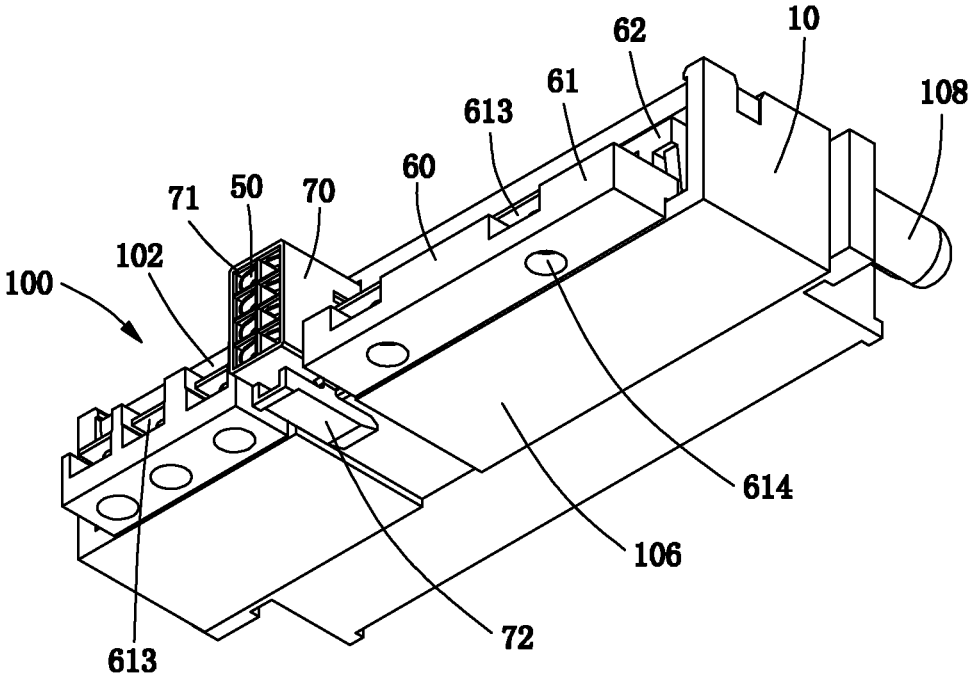
FIG. 3 is still a perspective view of the electrical connector.

Referring to FIGS. 1-3, the insulating housing 10 defines a mating face 101 for engaging with a complementary connector (not shown) and a mounting face 102 for insertion of the power contacts 20 and the signal contacts 30. A plurality of first passageways 103 for receiving the power contacts 20 and a plurality of second passageways 104 for receiving the signal contacts 30 are defined between the mating face 101 and the mounting face 102. The insulating housing 10 has a top wall 105, a bottom wall 106 parallel to the top wall 105, and a pair of side walls 107 connecting the top wall 105 and the bottom wall 106. The insulating housing is provided with a mating tongue (not labeled) and a pair of guiding posts 108 projecting from opposite sides of the mating tongue of the insulating housing 10. An opening 109 is defined at a rear side of the insulating housing 10 for receiving the first and the second spacers 60, 70. The opening 109 communicates with the first and the second passageways 103, 104, correspondingly. The power bus bar 40, the signal bus bar 50, the first and the second spacers 60, 70 can be received in the opening 109. A covering plate 11 is provided for extending across the opening 109 and partially covering the power bus bar 40, the signal bus bar 50, and the first and the second spacers 60, 70 received therein.

Figure 11:
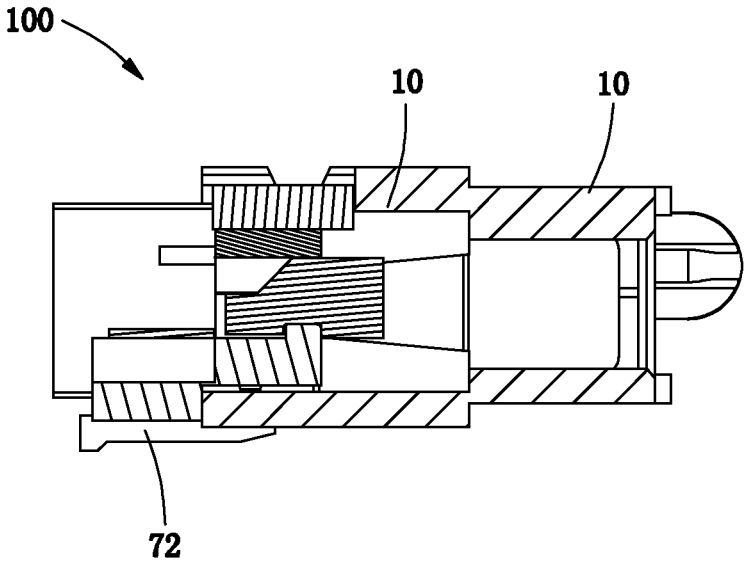
FIG. 11 is a cross-sectional view of the electrical connector taken along A-A direction of FIG. 1.
Figure 12:
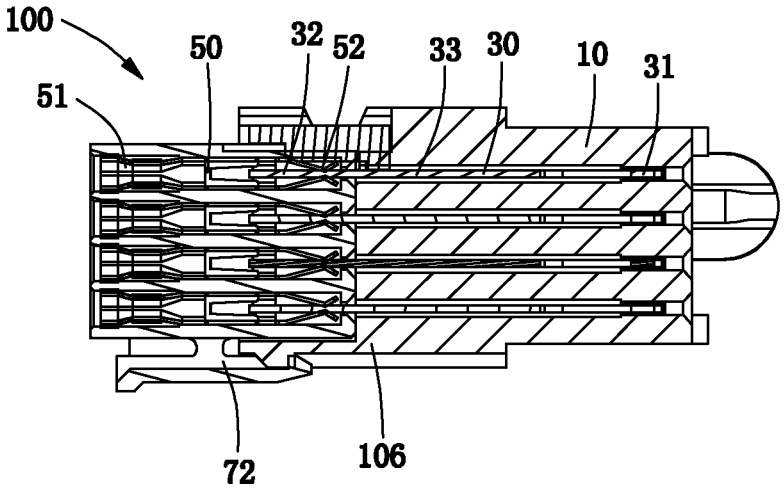
FIG. 12 is another side view of the electrical connector.
Figure 13:
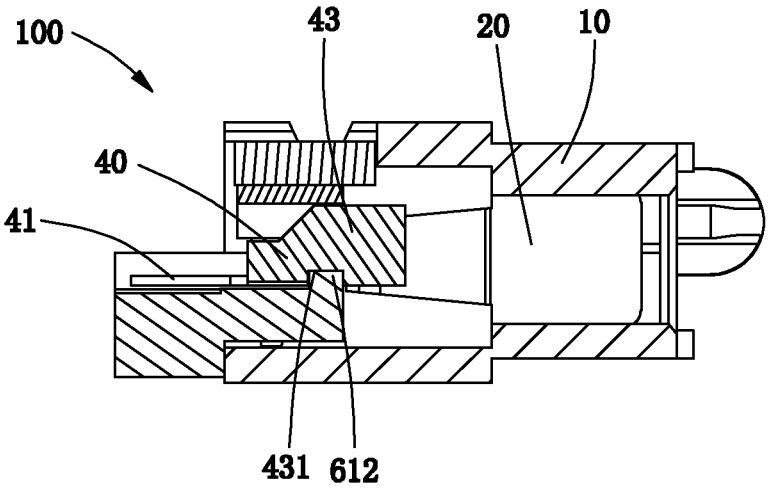
FIG. 13 is a cross-sectional view of the electrical connector taken along B-B direction of FIG. 1.

Together referring to FIGS. 4-5 and FIG. 11, the power contact 20 includes a first contacting portion 21 for electrically connecting with corresponding contacts of a complementary connector (not shown) and a first engaging portion 22 extending opposite to the first contacting portion 21. In the preferred embodiment, the power contact 20 is composed by two pieces of power contact halves 201, 202. Each power contact 20 is received in corresponding first passageway 103 with the first engaging portion 22 exposed to the opening 109 of the insulating housing 10. In this preferred embodiment, each power contact 20 is composed by two pieces of power contact halves 201, 202. The first power contact half 201 includes a first contacting end 210 and a first engaging end 220. The second power contact half 202 includes a second contacting end 230 and a second engaging end 240. The first contacting end 210 and the second contacting end 230 form the first contacting portion 21. The first engaging end 220 and the second engaging end 240 form the first engaging portion 22, which defines a fish-shape slot (not labeled). The first contacting end 210 and the second contacting end 230 each have a substantially flat, planar plate. The first contacting end 210 and the second contacting end 230 of the first contacting portion 21 are received in the first passageway 103. The first engaging end 220 and the second engaging end 240 of the first engaging portion 22 are exposed to the opening 109 of the insulating housing 10.

Figure 14:
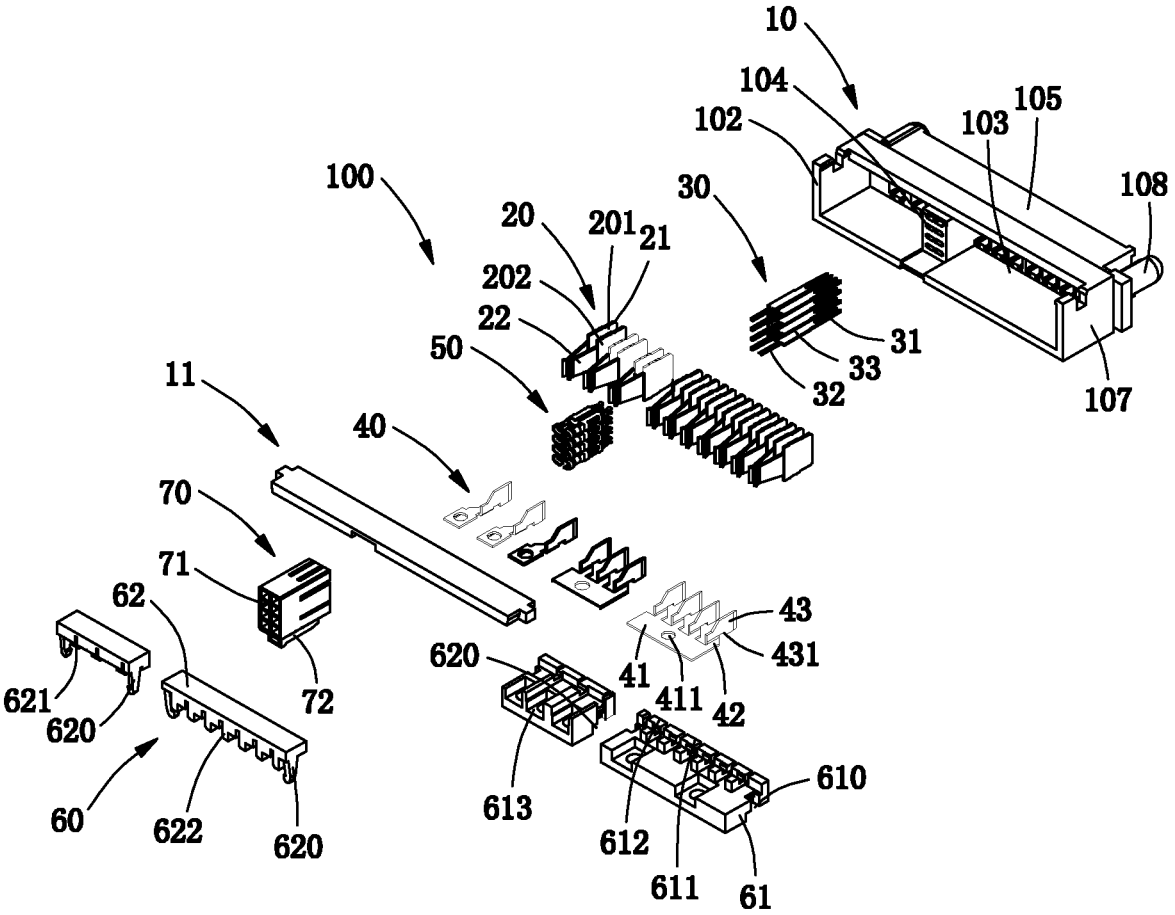
FIG. 14 is a cross-sectional view of the electrical connector taken along C-C direction of FIG. 1.
Figure 15:
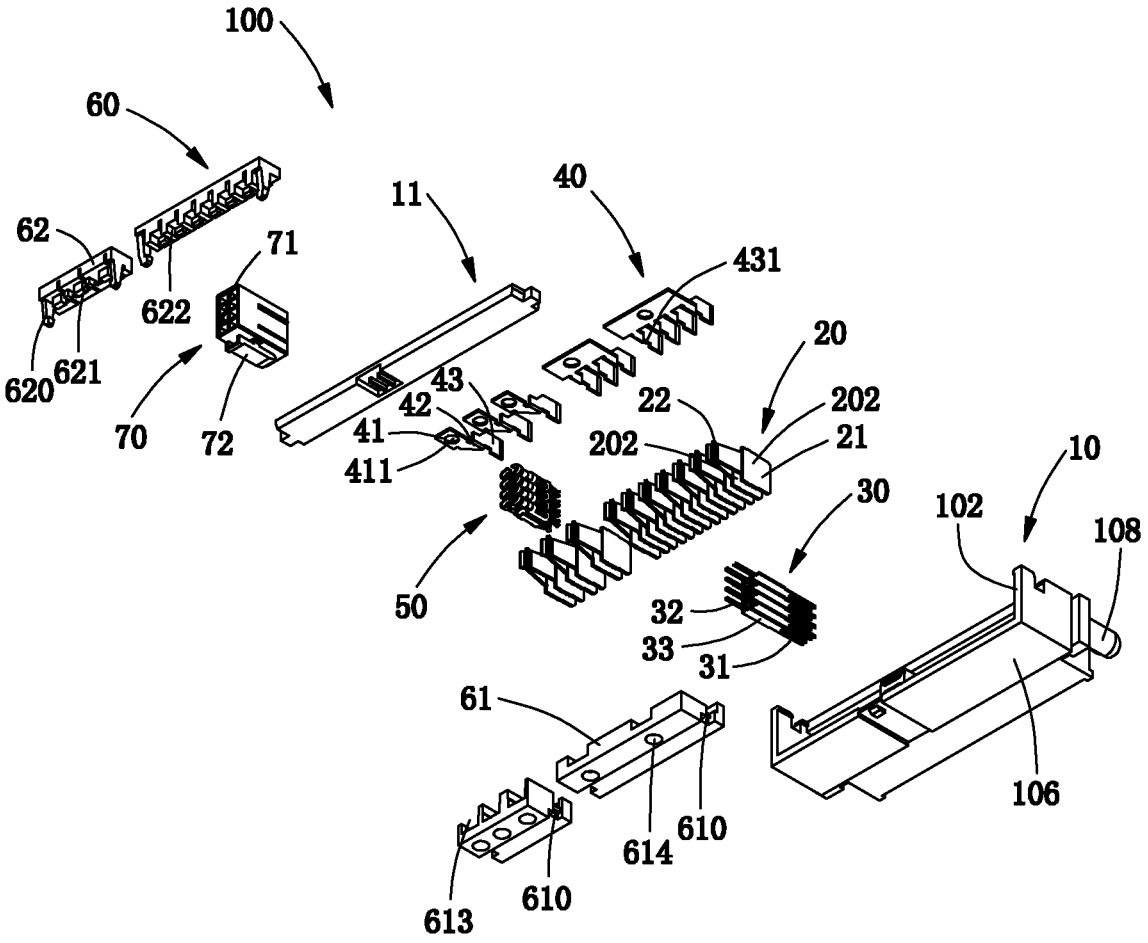
FIG. 15 is a cross-sectional view of the electrical connector taken along D-D direction of FIG. 1.

Referring to FIG. 14 together with FIGS. 4-5, the signal contact 30 includes a planar intermediate portion 33, a second contacting portion 31 and a second engaging portion 32 extending from opposite sides of the planar intermediate portion 33. The intermediate portion 33 is received in the second passageway 104. The second contacting portion 31 has a pair of contacting fingers (not labeled) for electrically and mechanically connecting with the contacts of the complementary connector. The second engaging portion 32 is beam-type, which engages within the signal bus bar 50. The details will be provided hereinafter.

Referring to FIGS. 1-10 and FIG. 15, the power bus bar 40 comprises a main section 41, a middle section 42 extending from the main section 41 and a connecting section 43 extending from the middle section 42. The connecting section 43 of the power bus bar 40 is configured to electrically and mechanically connect with the first engaging portion 22 of the power contact 20. The main section 41 extends along a first plane and the connecting section 43 extends along a second plane perpendicular to the first plane. In the preferred embodiment, the middle section 42 is located in the same plane with the main section 41. While, in the other embodiment, the middle section 42 does not need to be arranged in the same plane with the main section 41. The first contacting portion 21 of the power contact 20 extends parallel to the connecting section of the power bus bar 40. A plurality of holes 411 of the power bus bar 40 is defined through the main section 41 for connecting with the cable. The number of the holes 411 of the power bus bar 40 can be changed according to the numbers of the cable which are needed to be connected. In this embodiment, one of the plurality of power bus bars 40 has only one connecting tail (not labeled) which is composed the connecting section 43, one of the plurality of power bus bars 40 has three connecting tails which are composed the connecting section 43, and another one of the plurality of power bus bars 40 has four connecting tails which are composed the connecting section 43. The connecting tails are positioned separated from each other. Each connecting tail of the power bus bar 40 is configured to electrically and mechanically connecting with a corresponding power contact 20. The connecting tail of the power bus bar 40 is formed as a single-sheet flat blade. While, in other embodiment, the connecting tail of the power bus bar 40 can be formed as other configuration such as two-sheet flat blades. The connecting section 43 of the power bus bar 40 defines a positioning slit 431 thereon for engaging with a positioning protrusion 612 formed on the first spacer 60. Details will be given hereinafter.

Referring to FIGS. 1-7 and FIG. 14, the signal bus bar 50 comprises a cable-end section 51 and a connecting section 52 extending from the cable-end section 51. The cable-end section 51 is configured to engage with the second engaging portion of corresponding signal contact. The connecting section 52 of the signal bus bar has a pair of resilient fingers 521 (FIG. 14), which are applied for holding the second engaging portion 32 of the signal contact 30. The cable-end section 51 of the signal bus bar 50 has a semicircular cross section. In the other embodiment, the cable-end section 51 is changeable to connect with a cable.

Together referring to FIGS. 4-7, 9 and FIG. 15, the first spacer 60 comprises a first lower base 61 and a first upper base 62 engaging with the first lower base 61. In the preferred embodiment, two of the first spacer 60 are employed, which have the same structure while with different lengths. The first lower base 61 defines a pair of cutouts 610 at opposite ends thereof. the first upper base 62 forms a pair of locking arms 620 locking within corresponding cutouts 610 of the first lower base 61 to thereby securely connecting the first lower base 61 together with the first upper base 62. The first lower base 61 defines a plurality of lower slots 611 and the first upper base defines a plurality of upper slots 621. Each lower slot 611 and each corresponding upper slot 621 is cooperated to receive the connecting section 43 of the power bus bar 40. The first upper base 62 forms a plurality of fixing protrusions 622, which is pressed on the middle section 42 of the power bus bar 40. The positioning protrusion 612 is formed on the first lower base 61. The first lower base 61 forms a plurality of receiving portions 613. Each receiving portion 613 defines a hole 614 therethrough. The hole 614 of the receiving portion 613 is aligned with the hole 411 defined on the power bus bar 40 to thereby cooperate with each other to fixing the cable inserted therebetween.

Turning to FIGS. 4-5, the second spacer 70 is assembled to the rear side of the insulating housing 10. The second spacer 70 comprises a receiving section 71 for receiving the plurality of signal bus bars 50, and a lockable section 72 facing forwardly along an insertion direction of the complementary connector. The lockable section 72 is configured to lock with the bottom wall 106 of the insulating housing to thereby secure the second spacer 70 on the insulating housing 10.

During assembling, the plurality of power contacts 20 and the signal contacts 30 are respectively inserted into the first passageway 103 and the second passageway 104. Then, the power bus bars 40 are assembled to the first spacers 60 to thereby form a first subassembly. The signal bus bar 50 is assembled to the second spacer 70 to thereby form a second subassembly. Such subassemblies are then housed to the opening 109 of the insulating housing 10 from the rear side thereof. Consequently, the connecting sections 43 of the power bus bars 40 electrically and mechanically connect with corresponding the first engaging portions 22 of the power contacts 20, and the connecting sections 52 of the signal bus bars 50 electrically and mechanically connect with the second engaging portions 32 of the signal contacts 30. Finally, the covering plate 11 is assembled to the insulating housing 10 which partially covers the power bus bars 40, the signal bus bars 50, the first spacers 60 and the second spacer 70 received in the opening 109 of the insulating housing 10.

FIGS. 16-20 illustrate another embodiment of the present invention. The differences between the two embodiments will be described hereinafter in details.

Figure 16:
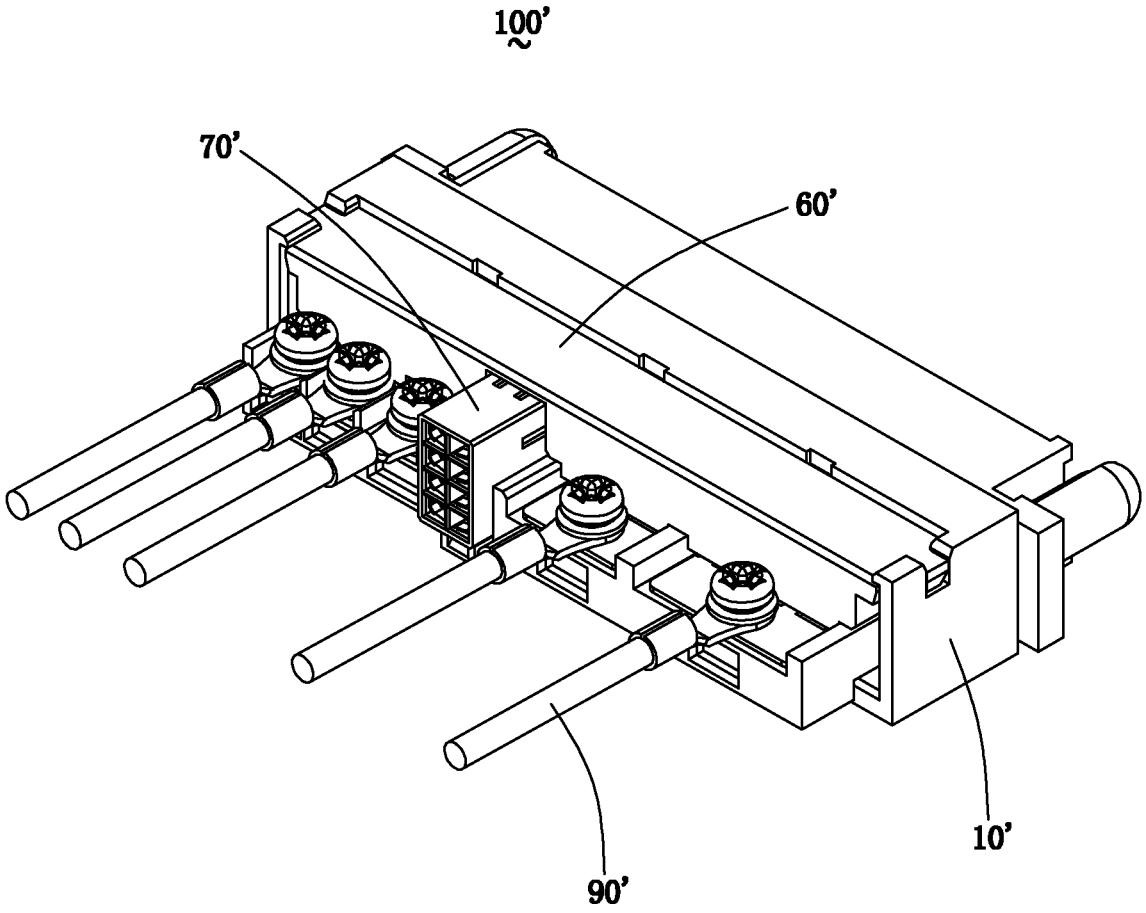
FIG. 16 is a perspective view of an electrical connector in accordance with the second embodiment of the present invention, in which a cable subassembly is shown.
Figure 17:
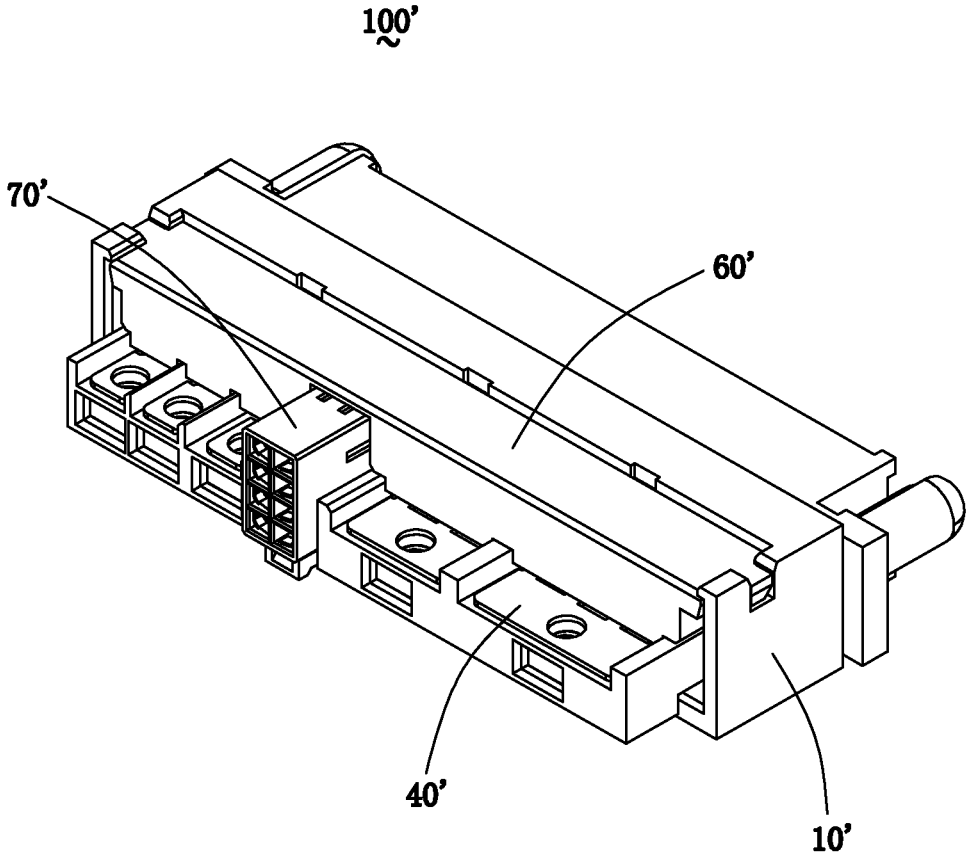
FIG. 17 is a view similar to FIG. 16 while without the cable subassembly.
Figure 18:
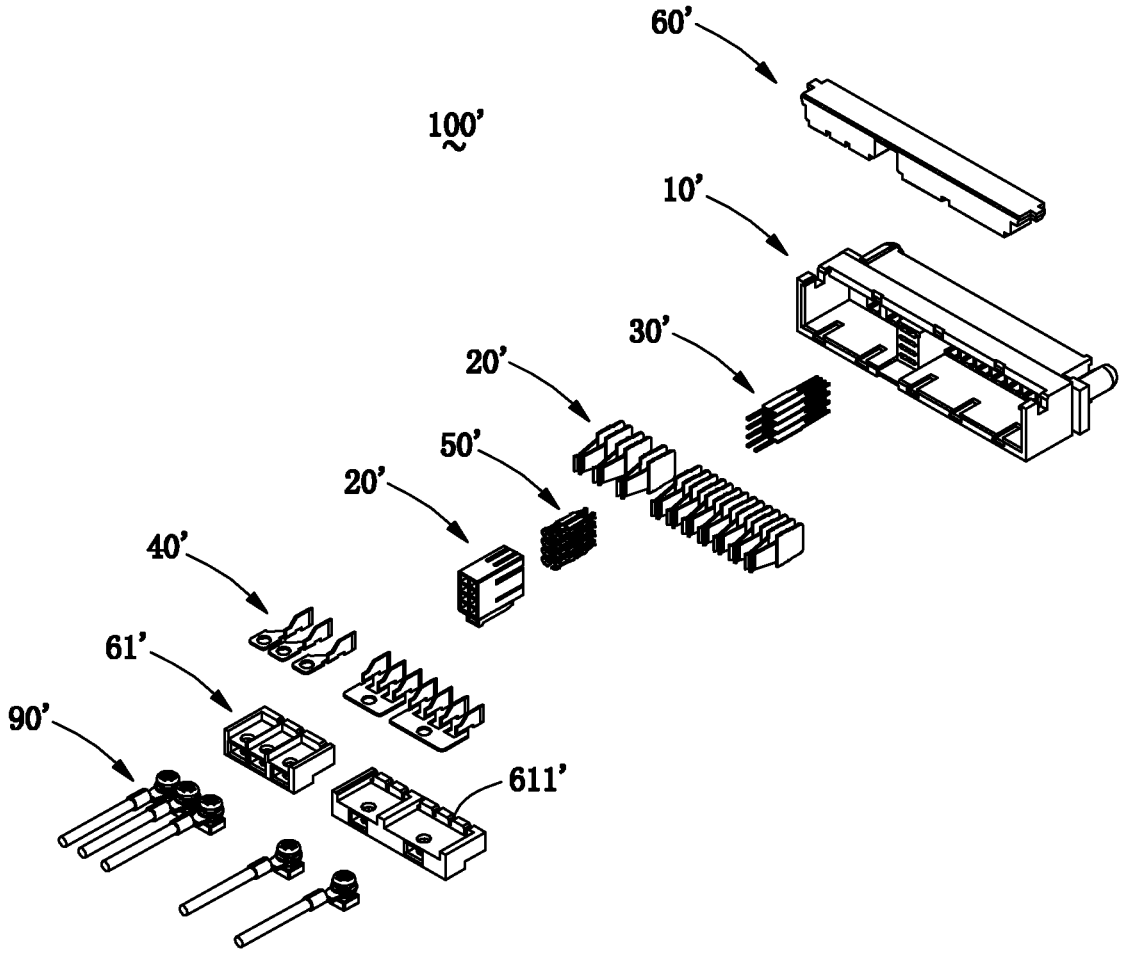
FIG. 18 is an exploded, perspective view of FIG. 16.
Figure 19:
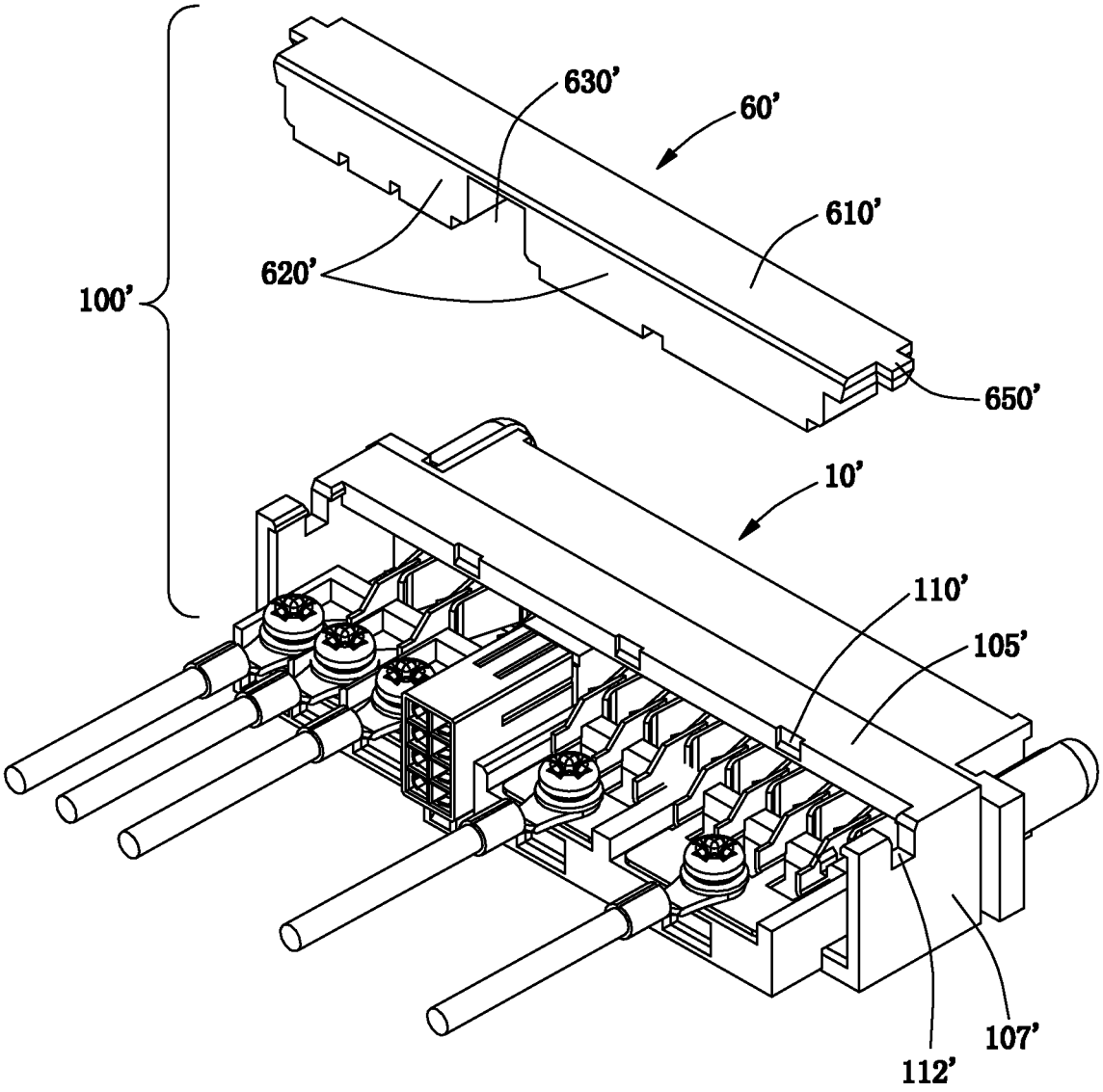
FIG. 19 is a partially exploded, perspective view of FIG. 16.
Figure 20:
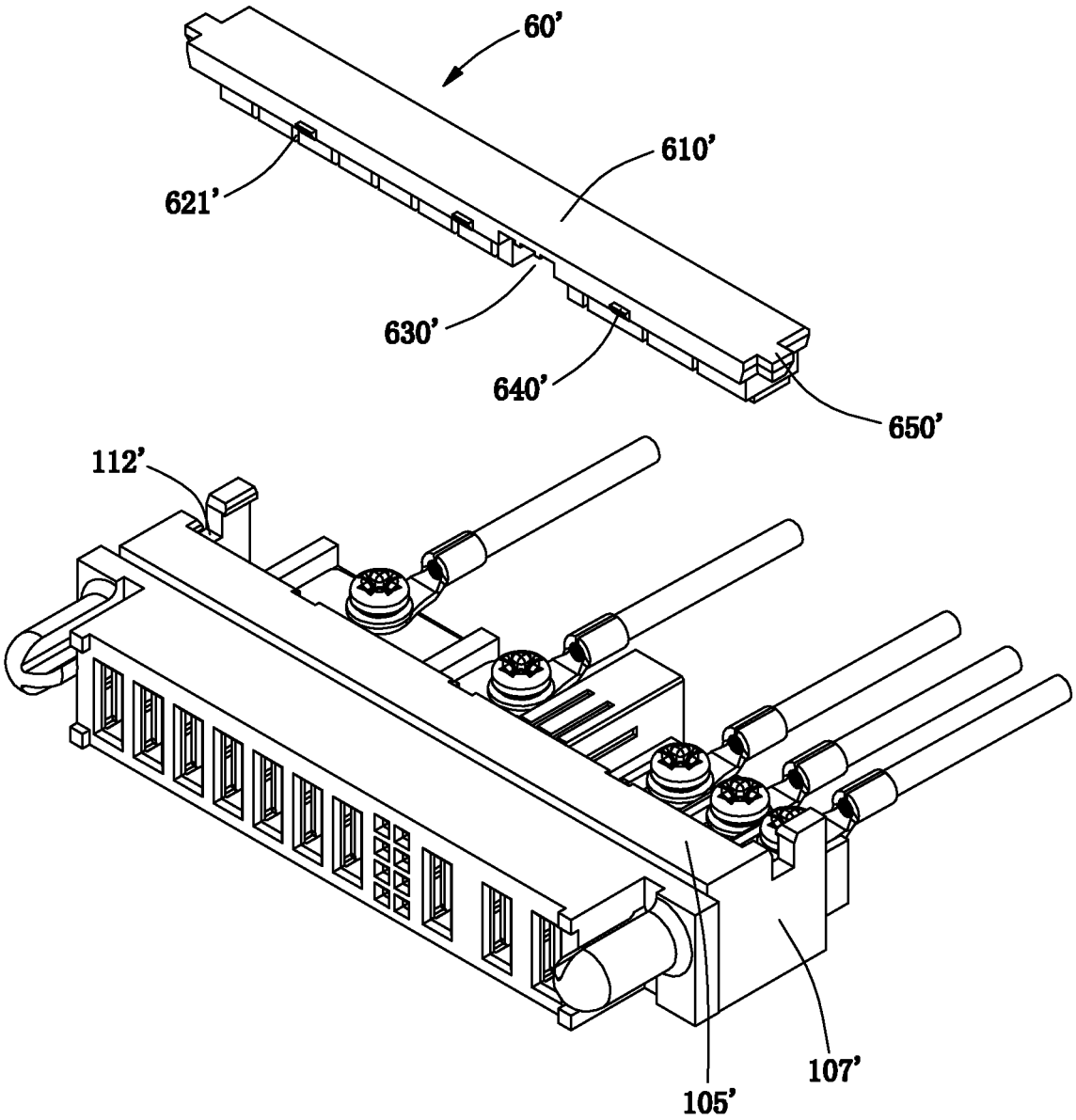
FIG. 20 is another partially exploded, perspective view of FIG. 16.

Referring to FIG. 16, an electrical connector 100' in accordance with the second embodiment of the present invention is shown. The electrical connector 100' comprises an insulating housing 10', a plurality of power contacts 20' assembled in the insulating housing 10', a plurality of signal contacts 30' received in the insulating housing 10', a plurality of power bus bars 40' connecting with the power contacts 20', a plurality of signal bus bars 50' connecting with the signal contacts 30', a first spacer 60' and a lower base 61' assembled to the insulating housing 10' for securing the power bus bars 40', and a second spacer 70' assembled to the insulating housing 10' for securing the signal bus bars 50'. Specifically, in the second embodiment, a cable subassembly 90', which is electrically connected to the power contacts 20' and the power bus bars 40', is shown.

Together referring to FIGS. 16-20, in the second embodiment, the first spacer 60' is integrally formed as one piece, which will reduce the manufacturing and assembling procedures. The basic structure of the first spacer 60' is similar to that of the first embodiment. In other words, the first spacer 60' is composed by the first upper base 62 of the first embodiment and the covering plate 11 of the first embodiment. In the second embodiment, the first spacer 60' comprises an elongate, main body 600' and two bases 620' extending downwards from the main body 600'. A recess 630' is defined between the two bases 620', in which the second spacer 70' is partially received. Each base 620' defines a plurality of slots 621' on a bottom face thereof. Each slot 621' is configured to cooperate with the lower slots 611' of the lower base 61' to thereby receive the connecting section 43' of the power bus bar 40'. The elongate, main body 600' forms a plurality of protrusions 640' thereon. The insulating housing 10' defines a plurality of grooves 110' on a rear face of the top wall 105' thereof. The protrusions 640 are received correspondingly in the grooves 110' to thereby secure the first spacer 60' on the insulating housing 10' along a transversal direction. The main body 600' also provides a pair of projections 650' on opposite sides thereof. The insulating housing 10' defines a pair of cutouts 112' on opposite side walls 107'. The projections 650' received in the cutout 112' to thereby secure the first spacer 60' on the insulating housing 10' along a front-to-back direction. As can be understood, the first spacer 60' can be also named as power contact spacer.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for connecting with a cable, comprising:

an insulating housing extending along a transversal direction and defining an opening at a rear side thereof, said insulating housing comprising a plurality of first passageways;

a plurality of power contacts received in corresponding first passageways of the insulating housing, each power contact forming a first engaging portion and a first contacting portion;

a power bus bar electrically and mechanically connecting with at least one power contact, said power bus bar having a main section, a middle section extending from said main section, and a connecting section extending from said middle section, said connecting section engaging with said first engaging portion of said at least one power contact; and a power contact spacer assembled within said opening of said insulating housing, said power contact spacer including a main body and a base extending downwards from the main body;

wherein the main body of the power contact spacer provides a plurality of protrusions along the transversal direction, and wherein the insulating housing defines a plurality of grooves on a top wall thereof for correspondingly receiving the protrusions to thereby secure the power contact spacer on the insulating housing along a transversal direction.

2. The electrical connector as claimed in claim 1, further comprising a lower base, wherein the power contact spacer cooperates with the lower base to thereby secure the power bus bar therebetween.

3. The electrical connector as claimed in claim 2, wherein the base of the power spacer defines a plurality of slots for retaining therein the connecting sections of said power bus bar.

4. The electrical connector as claimed in claim 2, wherein the main body of the power contact spacer forms a pair of projections at opposite sides thereof, and wherein the insulating housing defines a pair of cutouts on opposite side walls for receiving the projections to thereby secure the power contact spacer on the insulating housing along a front-to-back direction.

5. The electrical connector as claimed in claim 4, wherein the power contact spacer has a pair of bases extending from the main body.

6. The electrical connector as claimed in claim 5, wherein the power contact spacer defines a recess between the pair of bases.

7. The electrical connector as claimed in claim 1, wherein each of said power contacts includes two pieces of power contact halves, and the first engaging portion defines a fish-shape engaging slot therethrough.

8. The electrical connector as claimed in claim 7, wherein said connecting section of said power bus bar includes at least two connecting tails.

9. The electrical connector as claimed in claim 8, wherein each of said connecting tail of said connecting section of said power bus bar is received and sandwiched within said fish-shape engaging slot of said first engaging portion of said at least one power contact.

10. The electrical connector as claimed in claim 9, wherein said connecting tail of said connecting section of said power bus bar is a single-sheet flat blade.

11. The electrical connector as claimed in claim 10, wherein said connecting tail of said connecting section of said power bus bar is composed by two-sheet flat blades.

12. The electrical connector as claimed in claim 1, further comprising a plurality of signal contacts and a plurality of signal bus bars each electrically and mechanically connecting with corresponding signal contact, each signal contact forming a second engaging portion and a second contacting portion.

13. The electrical connector as claimed in claim 12, wherein each signal bus bar has a cable-end section and a connecting section extending from said cable-end section for engaging with corresponding second engaging portion of said signal contact.

14. The electrical connector as claimed in claim 13, further comprising a signal contact spacer defining a plurality of channels for receiving corresponding signal contact and signal bus bar.

* * * * *